US007735539B2

(12) United States Patent
Nakamura et al.

(10) Patent No.: US 7,735,539 B2
(45) Date of Patent: Jun. 15, 2010

(54) FIRE-RESISTANT SMOKE-SUPPRESSANT DEVICE

(75) Inventors: Satoshi Nakamura, Tokyo (JP); Tadanori Tashiro, Tokyo (JP)

(73) Assignee: Nohara Guard System Co. Ltd., Tokyo (JP)

( * ) Notice: Subject to any disclaimer, the term of this patent is extended or adjusted under 35 U.S.C. 154(b) by 133 days.

(21) Appl. No.: 11/966,872

(22) Filed: Dec. 28, 2007

(65) Prior Publication Data

US 2009/0165963 A1 Jul. 2, 2009

(51) Int. Cl.
*A62C 2/10* (2006.01)

(52) U.S. Cl. ..... 160/243; 160/273.1; 169/48

(58) Field of Classification Search ..... 160/243, 160/268.1, 269, 273.1, 7, 9; 169/48
See application file for complete search history.

(56) References Cited

U.S. PATENT DOCUMENTS

| | | | |
|---|---|---|---|
| 862,644 | A | 8/1907 | Kepler |
| 2,564,208 | A | 8/1951 | Michelman |
| 2,582,276 | A | 1/1952 | Powers |
| 3,006,352 | A | 10/1961 | Hozak |
| 3,016,952 | A | 1/1962 | Shero |
| 3,306,345 | A | 2/1967 | Youngs |
| 3,398,779 | A | 8/1968 | Kuss |
| 3,687,185 | A | 8/1972 | Singer |
| 3,766,958 | A | 10/1973 | Mitchell |
| 3,807,480 | A | 4/1974 | Smart |
| 3,877,525 | A | 4/1975 | Husson et al. |
| 3,955,330 | A | 5/1976 | Wendt |
| 3,960,216 | A | 6/1976 | Isobe et al. |
| 3,964,214 | A | 6/1976 | Wendt |
| 4,077,474 | A | 3/1978 | Hattori et al. |
| 4,079,772 | A | 3/1978 | Klaenhammer et al. |
| 4,398,371 | A | 8/1983 | Jenkins |
| 4,802,523 | A | 2/1989 | Scholten et al. |
| 5,056,839 | A | 10/1991 | Yoon et al. |
| 5,088,543 | A | 2/1992 | Bilbrey |
| 5,195,594 | A | 3/1993 | Allen |
| 5,199,478 | A | 4/1993 | Kubota et al. |
| 5,237,776 | A | 8/1993 | Kubota et al. |

(Continued)

FOREIGN PATENT DOCUMENTS

| | | |
|---|---|---|
| DE | 3151506 | 7/1983 |

(Continued)

OTHER PUBLICATIONS

International Search Report for Application No. PCT/US07/74626; Applicant: SmokeGuard, Inc.; Date of Mailing: Jul. 26, 2007 (2 pages).

*Primary Examiner*—David Purol
(74) *Attorney, Agent, or Firm*—Perkins Coie LLP

(57) ABSTRACT

A deployable heat and smoke obstacle is disclosed. A screen is wound around a shaft over a passageway in a building or a vehicle. The shaft can rotate in response to an alarm signal to deploy the screen over the passageway to prevent smoke and heat from passing through the passageway. The screen includes magnetic sheets that engage a corresponding magnetic surface near the passageway to hold the screen in place over the passageway. The screen also includes heat-sensitive fasteners that deform when heated to engage corresponding holes in the passageway to hold the screen in place over the passageway.

12 Claims, 9 Drawing Sheets

U.S. PATENT DOCUMENTS

| | | | |
|---|---|---|---|
| 5,373,932 | A | 12/1994 | Stobich et al. |
| 5,383,510 | A | 1/1995 | Allen |
| 5,482,103 | A | 1/1996 | Burgess et al. |
| 5,540,269 | A | 7/1996 | Plumer et al. |
| 5,607,758 | A | 3/1997 | Schwartz |
| 5,758,705 | A | 6/1998 | Wagner et al. |
| 5,836,424 | A | 11/1998 | Allen |
| 5,862,851 | A | 1/1999 | Stoebich |
| 5,896,907 | A | 4/1999 | Dever et al. |
| 6,019,156 | A | 2/2000 | Wagner et al. |
| 6,070,640 | A | 6/2000 | Miyagawa et al. |
| 6,082,432 | A | 7/2000 | Kissinger |
| 6,138,739 | A | 10/2000 | Crider et al. |
| 6,201,364 | B1 | 3/2001 | Will et al. |
| 6,357,507 | B1 | 3/2002 | Stoebich et al. |
| 6,715,183 | B1 | 4/2004 | Lautenschlager et al. |
| 7,000,668 | B2 | 2/2006 | Sears et al. |
| 7,028,742 | B2 | 4/2006 | Sears et al. |
| 7,034,682 | B2 | 4/2006 | Beggs et al. |
| 7,299,848 | B2 | 11/2007 | Streib et al. |
| 2002/0059985 | A1 | 5/2002 | Stoebich et al. |
| 2006/0226103 | A1 | 10/2006 | Streib et al. |

FOREIGN PATENT DOCUMENTS

| | | |
|---|---|---|
| DE | 3417761 | 11/1985 |
| DE | 4102330 | 8/1992 |
| DE | 19611515 | 10/1996 |
| DE | 19610532 | 11/1996 |
| DE | 19718238 | 11/1998 |
| DE | 19836008 | 2/2000 |
| DE | 19925722 | 12/2000 |
| DE | 19655126 | 5/2001 |
| DE | 20303183 | 5/2003 |
| DE | 10213811 | 10/2003 |
| DE | 10225251 | 12/2003 |
| DE | 10234802 | 2/2004 |
| DE | 10325237 | 12/2004 |
| DE | 102004019262 | 12/2004 |
| DE | 202006009416 | 8/2006 |
| DE | 202006009851 | 9/2006 |
| EP | 124910 | 11/1984 |
| EP | 163987 | 12/1985 |
| EP | 440094 | 8/1991 |
| EP | 1215362 | 6/2002 |
| EP | 1249255 | 10/2002 |
| EP | 1669110 | 6/2006 |
| GB | 2060744 | 5/1981 |
| GB | 2108839 | 5/1983 |
| GB | 2202890 | 10/1988 |
| GB | 2332860 | 7/1999 |
| JP | 9013533 | 1/1997 |
| JP | 9078726 | 3/1997 |
| JP | 9203281 | 8/1997 |
| JP | 9217256 | 8/1997 |
| JP | 9263463 | 10/1997 |
| JP | 9263464 | 10/1997 |
| JP | 9263465 | 10/1997 |
| JP | 10102628 | 4/1998 |
| JP | 10152913 | 6/1998 |
| JP | 10152914 | 6/1998 |
| JP | 10324542 | 12/1998 |
| JP | 2000017977 | 1/2000 |
| JP | 2000246821 | 9/2000 |
| JP | 2001107660 | 4/2001 |
| WO | WO-9743011 | 11/1997 |
| WO | WO-03080188 | 10/2003 |

FIRE-RESISTANT SMOKE-SUPPRESSANT DEVICE

TECHNICAL FIELD

This invention is concerned with the smoke-suppressant device of an opening, especially in providing a fire-resistant smoke-suppressant device whose sealing function of the opening is not lost even in fire or high temperature smoke, and can seal the opening of an elevator or hallway when necessary, along with shutting out flames and smoke, that is high in fire resistance, and is able to securely anchor the smoke or flame suppressant screen to the opening frame.

BACKGROUND

A device that shuts out smoke and harmful gases during fire by opening and closing a screen that is on the front side of an opening for an elevator has been known, such as referred to in the below stated Patent Literature 1 and 2. Here, the invention mentioned in Patent Literature 1 (Tokuhyo Hei 10-506158 Official Gazette) is directed to rolling down a reinforced curtain on the front side of an elevator opening when necessary.

In this invention, ferromagnetic side rails are located on both sides of the elevator opening and flexible magnetic strips are placed at both ends of both sides of the screen. Also, the reinforced curtain that makes up the screen has a structure that makes it possible for the screen to be rolled up or down by a pair of pulleys located at both ends of the space bar, situated at the ends of the curtain as a space bar to roll such curtain up.

Also, there is a motor-driven drive method that freely rotates forward and backward above the above stated opening; the shaft of this drive method is connected to Pulley #1 and by rolling in and rolling back the connection cord rolled up by the pair of pulleys on both sides of the above stated space bar, it is possible to move the above stated screen to these opening and closing positions. In this case, when rolling the screen down, it is possible to use the dead weight of the curtain rolled into the space bar to lower it.

Also, Patent Literature 2 (Tokukai 2005-113509 Official Gazette) mentions an invention as summarized below, which improves on the above stated Patent Literature 1 invention. This invention of Patent Literature 2 deals with a screen device that closes at least part of an opening with a flexible screen material whose top end is anchored at the top end of the opening, and is characterized by making it possible for the previously stated opening to open by placing a flexible adhesion method on both ends of the previously stated screen material, and rolling up the strip or line form flexible material attached to the screen material along with adhering in an attachable and removable manner both ends of the screen through such adhesion method.

In addition, those with a manual or electronic rotating drive winding shaft located on the upper part of the above stated opening, move the above stated screen material vertically by rolling up or back the above stated flexible material through such winding shaft, and also utilize silica cloth or glass cloth that is high in fire-resistance for the above stated screen material are mentioned as well.

Patent Literature 1—Tokuhyo Hei 10-506158 Official Gazette

Patent Literature 2—Tokukai 2005-113509 Official Gazette

When setting a smoke-suppressant device with the above mentioned widely known screen material on the opening of an elevator, for example, it is structured in such a way that such screen material is adhered and anchored utilizing flexible magnetic strips to the ferromagnetic frame form on both sides of the opening or side rails. Due to this structure, there was a fault in that the flexible magnetic strips used for adhesion anchoring themselves would lose magnetism due to flames or high temperature and the screen material would separate from the opening, even if highly fire-resistant material was used for the screen material. In other words, the fault was that regular flexible magnetic strips can not be used as a smoke-suppressant device requiring fire-resistant capabilities, as there were problems with loss of magnetism at temperatures of over approximately 600° C.

DETAILED DESCRIPTION

Figure 1:
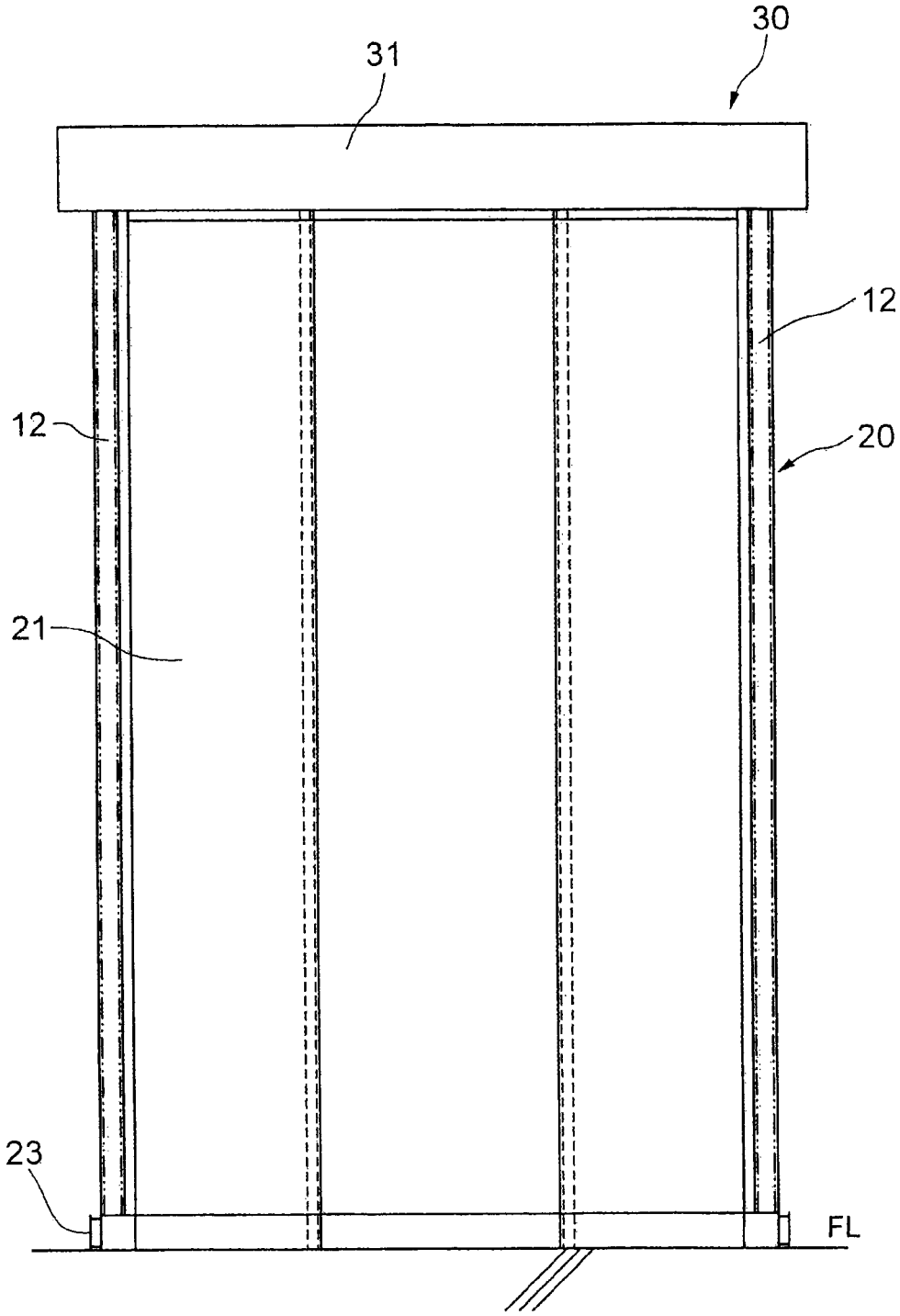
FIG. 1 is a front view of a fire-resistant smoke-suppressant device installed in an elevator opening in accordance with an embodiment of the present invention.

A smoke-suppressant device in accordance with embodiments of the present invention that is highly fire-resistant and does not lose its sealing functions of the opening in response to flames or high temperature smoke, and to do this, improves upon the structure of anchoring to the smoke-suppressant screen opening frame.

A fire-resistant and smoke-suppressant device of at least one embodiment is provided that comprises a fire-resistant sheet screen rolled up and down in front of an opening, sheet type magnetic strips situated on both sides of such screen, and support rails made of ferromagnetic materials situated on both sides of the opening; a type of fire-resistant smoke-suppressant device in which such sheet type magnetic strips adhere to the support rails when deployed to protect the opening with the screen, has multiple other anchor means in such sheet type magnetic strips part, has a thermal expansion sheet that prevents temperature rise in all of these anchor means, and has a characteristic of preventing further temperature rise of all of these anchor means by expansion of the thermal expansion sheet in response to temperature rise due to fire or high temperature smoke. The fire-resistant and smoke suppressant device of an embodiment has a shape-memory alloy anchor mean as stated above that is in pole form, and is characterized by anchoring through connecting, by both its ends curving in respect to the rise in temperature, to the support rail connecting part.

The heat expansion sheet is located on the front side and both sides of all of the anchor means, and the other anchor means for shape-memory alloy as stated above are characterized by both ends of the pole form curving and connecting to the multiple connection holes located along the support rail or vertical groove located on the outside of the above stated support rail.

In addition, it is a fire-resistant smoke-suppressant device in which the above screen is rolled on to the lower shaft, is rolled down by its own weight, by releasing the roll-up wire that is anchored to both ends of such shaft, and has a characteristic of this release being signaled by a fire alarm, temperature detector, or smoke detector, or signal from a manual switch.

With this device, in accordance with embodiments of the invention, it is possible to shut out flames and high temperature smoke for long periods of time, through the use of sheet form magnetic strips as screen anchoring means for the smoke-suppressant device, surrounding this with a heat expansion sheet to protect it from heat, and furthermore, stopping the peeling of such sheet form magnetic strip from the support rail for adhesion anchoring through other anchoring means using shape-memory alloy. Through this, we are able to provide a high performance fire-resistant smoke-suppressant device that can be placed in elevator openings and hallway openings that require high fire resistance.

The implementing structure for this invention will be explained through FIGS. 1 through 9.

Figure 2:
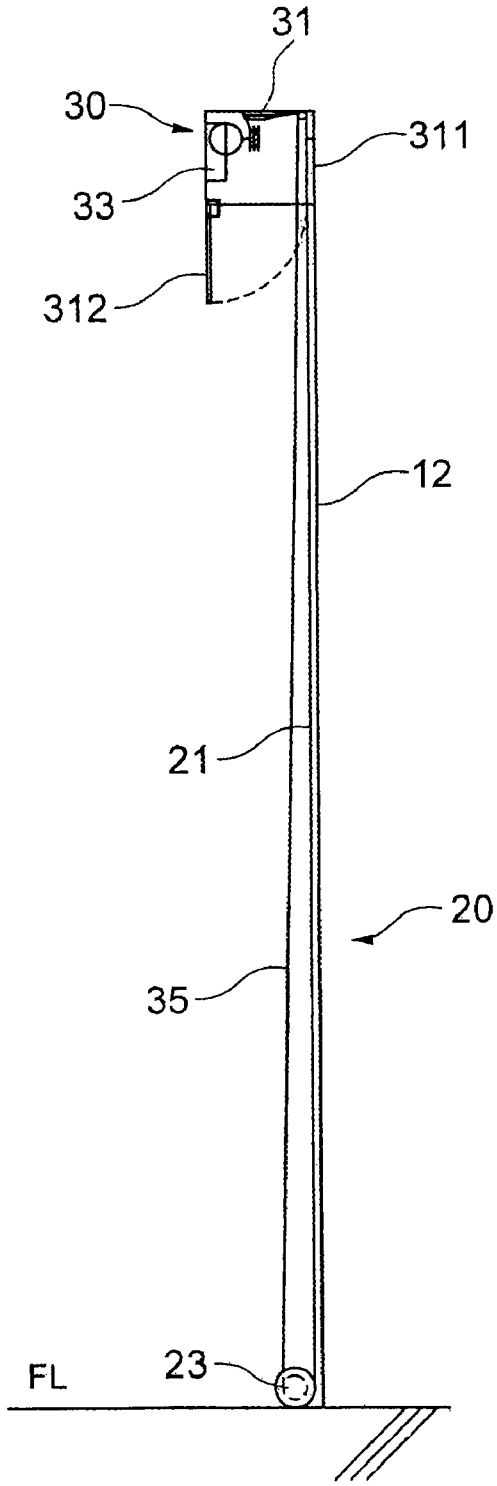
FIG. 2 is a side view of the device of FIG. 1.

FIG. 1 shows the front side view of this invention's Smoke-Suppressant Device 20 placed at the opening for an elevator on a building; and FIG. 2 shows a rough side view of the area in which this Smoke-Suppressant Device 20 was placed.

As can be seen through these Figures, Smoke-Suppressant Device 20 is shown in a position where Screen 21 is sealing off the elevator opening (see FIG. 3), and shows the shaft for rolling up Screen 21 (see FIG. 3), Shaft End 23, having reached the Floor FL.

The characteristic structure of an embodiment of the present invention will be discussed later. Screen 21, which is normally rolled up and stored in Storing Box 31 that is above the opening, is deployed by the movement of Winding Device 30 triggered by the signal from a smoke detector and such that are not shown, and seals the front side of such opening. At this point, the sheet form magnetic strips located on the back side of Screen 21 are adhered to the ferrous material Support Rails 12, and the sealing of such opening is the same as the previous, well-known inventions.

Here, the structure of the screen sheet itself is made of, for example, long stainless fiber fabric or polyimide fiber fabric that is put together width-wise. Also, this sort of Screen 21 is wrapped around the lower shaft (only Shaft End 23 is shown), and it can be stored in Storing Box 31 after rolling Wire 35 up with the winding device above.

In FIGS. 1 and 2, the winding shaft is shown lowered by letting out Wire 35 from Winding System 30, so Shaft End 23 is stopped on Floor FL and Storing Box 31 and Panel Door 312 are left open.

Figure 3:
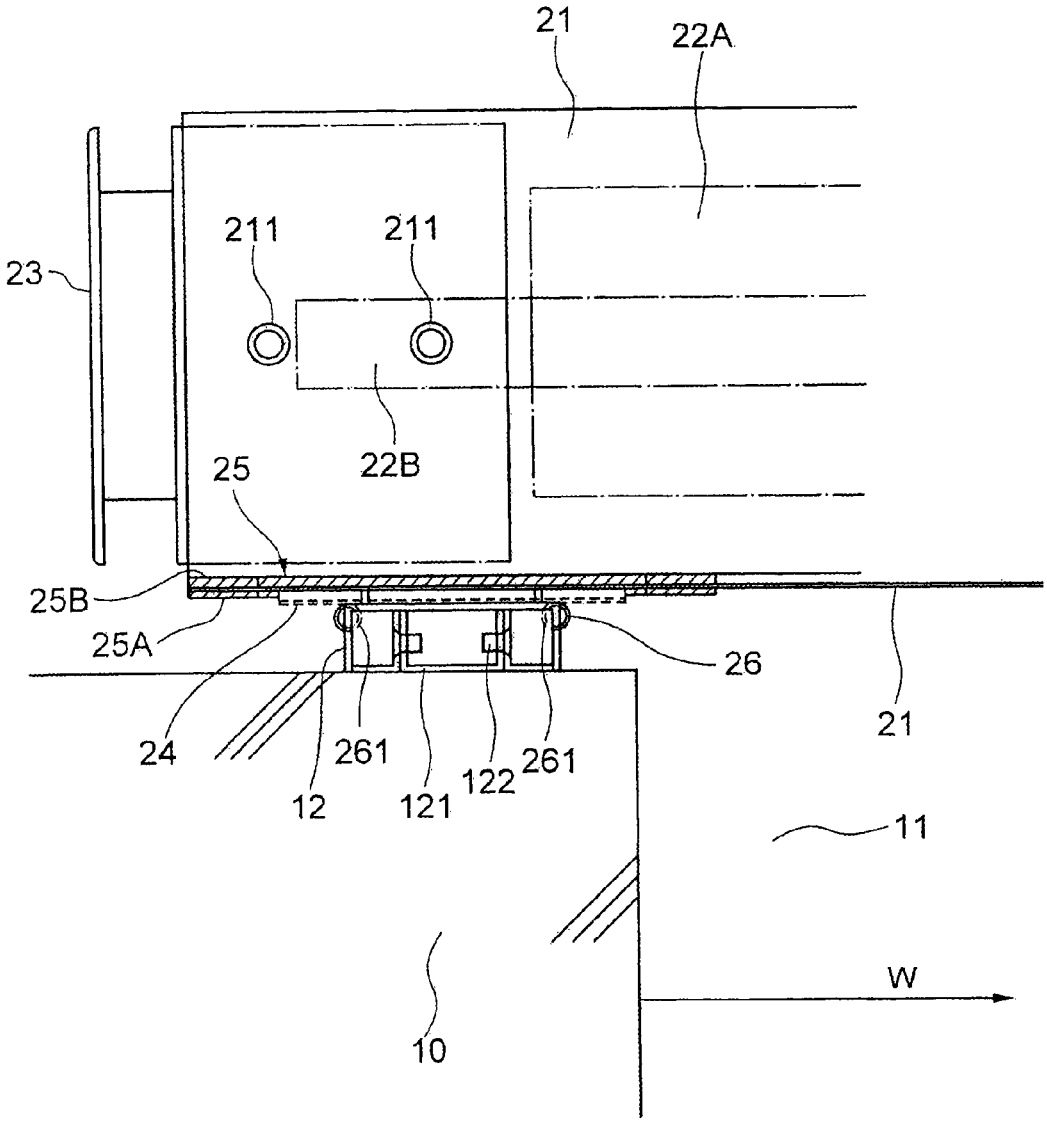
FIG. 3 is a horizontal section view of the device of FIG. 1 including one side of the screen winding part.
Figure 4:
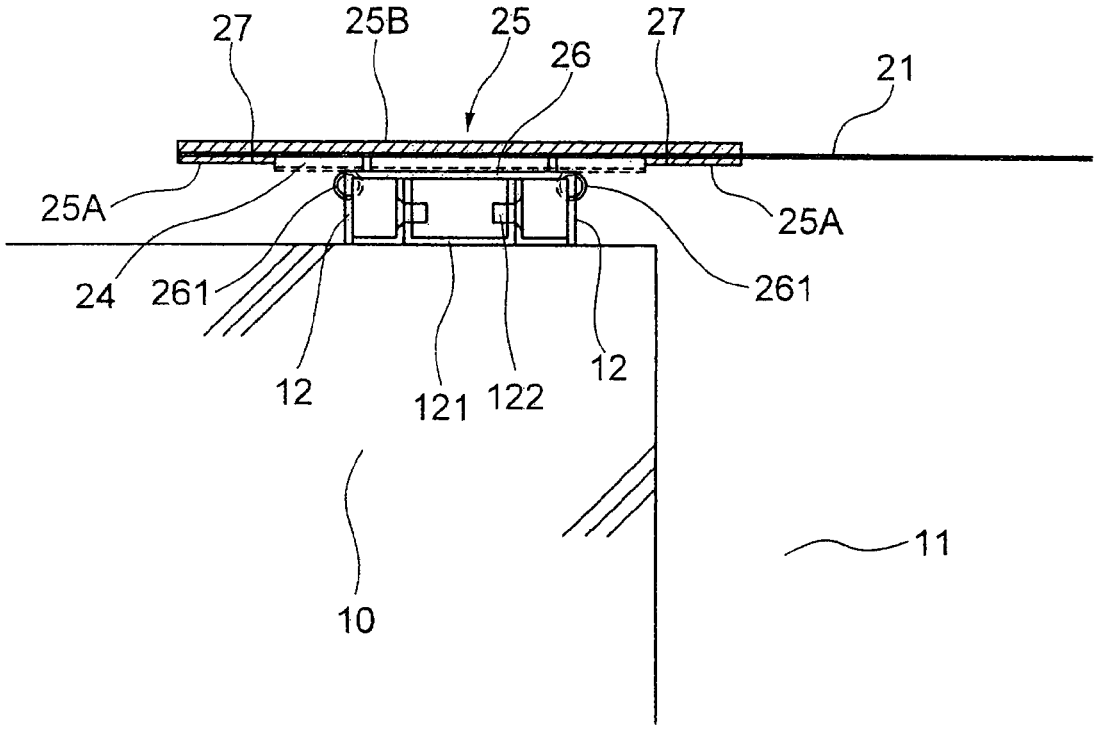
FIG. 4 is a center horizontal section view of one side of the device of FIG. 1.

FIGS. 3 and 4 show one of the most characteristic structures of this invention. In FIG. 3, for the partial horizontal section view Building Structure Part 10 and the side frame structure of Elevator Opening part 11, Support Rail Base Material 121 is anchored to such frame structure by anchors (see FIG. 8, etc.), and Support Rail 12 is anchored and placed by Support Rail Attachment Material 122.

On the other hand, Screen 21 is wrapped around Shaft 22A and 22B like those that were previous publicly known, and Shaft End 23, Screen Attachment Material 211, 211, and such are shown. In the side end part (only one direction shown) of Screen 21, this device's characteristic structure of the Sheet Form Magnetic Strip 24 part and Insulation Method 25 are shown. Here, the structure of Sheet Form Magnetic Strip 24 itself can utilize the same thing as the flexible magnetic strip released in Patent Literature 1 above and previously known.

In Insulation Method 25, it will be explained in other Figures as well, Heat Expansion Sheets 25A and 25A are anchored on both sides of Sheet Form Magnetic Strip 24 that is anchored to both end parts of the above mentioned Screen 21, and Heat Expansion Sheet 25B is anchored to the opposite side of Screen 21 from such Magnetic Sheet. The function of this will be explained later. In the case that the temperature of the above Screen 21 and Heat Expansion Sheet rises due to flames or high temperature smoke, Heat Expansion Sheets 25A and 25B expand from the temperature, sealing off with Head Expansion Sheet 25B the conducting of heat from the front side of Screen 21 to Sheet Form Magnetic Strip 24, and at the same time sealing off the heat conducting from the side of Sheet Form Magnetic Strip 24 on the back side of Screen 21 with the expanded Heat Expansion Sheets 25A and 25A.

Now, to explain the application of Heat Expansion Sheets 25A and 25B used in Insulation Method 25, Heat Expansion Sheets 25A and 25A are each approximately 20 mm wide, approximately 2.1 mm thick, made of butyl rubber sheet containing graphite, and the expansion rate is approximately 10 times. Heat Expansion Sheet 25B is also made of the same material and is approximately 120 mm wide and approximately 2.1 mm thick. Number 27 on FIG. 4 shows the stainless fiber that faces Heat Expansion Sheets 25A and 25B on the front and back of the above stated Screen 21.

FIG. 3 and FIG. 4 show Screen Anchoring Method 26 located on both sides of the above mentioned Screen 21 in its connected position. Although FIGS. 7 through 9 will be explained later, many of these Screen Anchoring Methods 26 are fitted on the above mentioned Sheet Form Magnetic Strip 24 and 24 and, though each of these is in pole form normally, if the pole itself is heated to a temperature higher than the designated temperature, each pole form changes shape at both ends and is structured to fit and connect to Connection Holes H through H (see FIGS. 7, 9) situated on both sides of the illustrated Support Rail 12.

This sort of screen anchoring method is one of the most characteristic structures of this device; the above mentioned pole form screen anchoring method is made of a shape-memory alloy, and, for example, changes shape when such Screen Anchoring Method 26 reaches a temperature of 100° C., structured so both ends curve as illustrated. In this application, such shape-memory alloy is comprised of a nickel and titanium alloy, is approximately 70 mm long, 5 mm wide, 0.5 mm thick, and its reaction temperature is at approximately 100° C. Accordingly, even though it is in pole form (thin board form) as stated above at normal temperature, both of the ends curve when the designated reaction temperature of 100° C. is reached, and as will be explained later for each of the End Connection Hooks 261 and 261, it anchors Screen 21 to Support Rail 12 by fitting into Connection Holes H through H that are situated on both sides of Support Rail 12.

Figure 5:
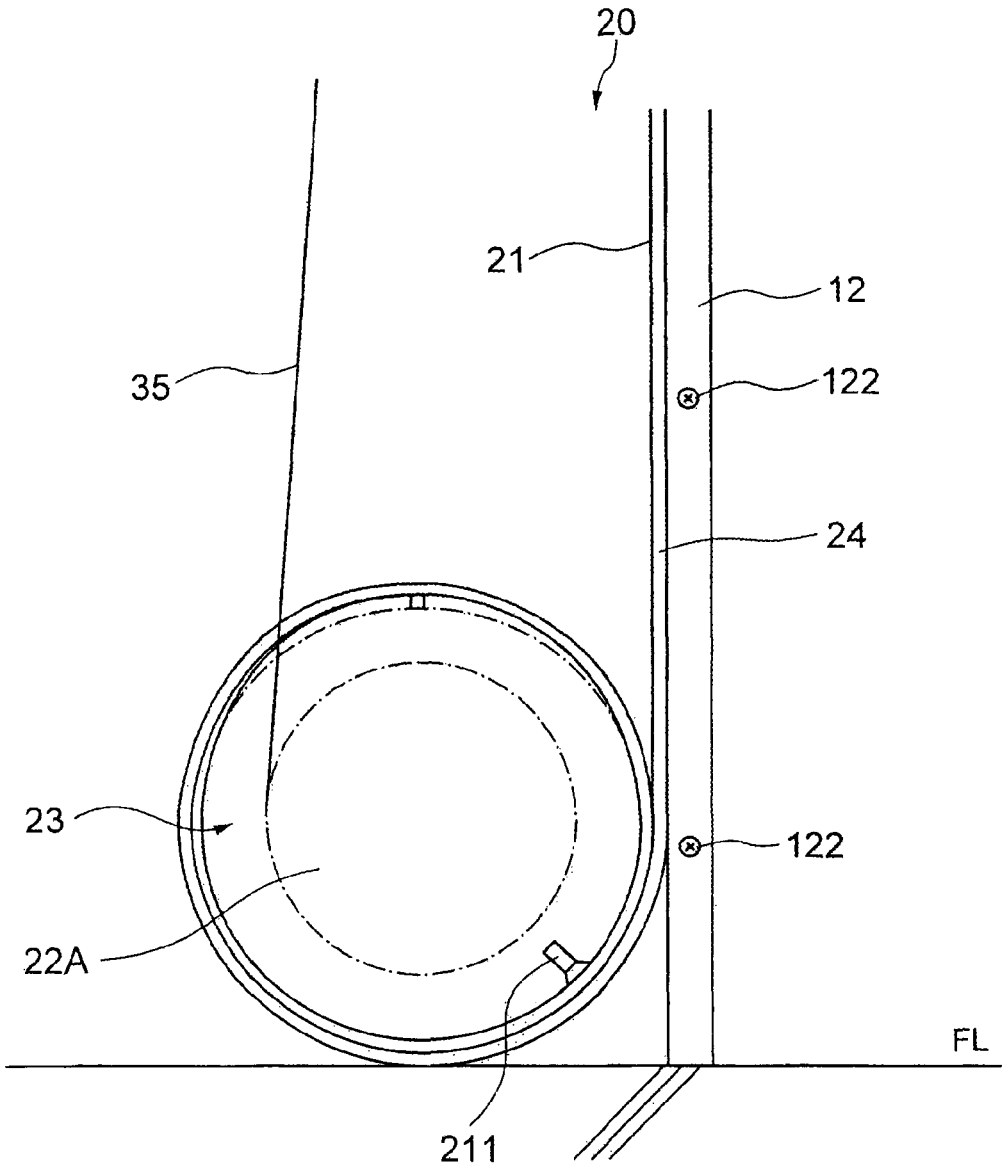
FIG. 5 is a close-up view of the lower part of the device of FIG. 2.
Figure 6:
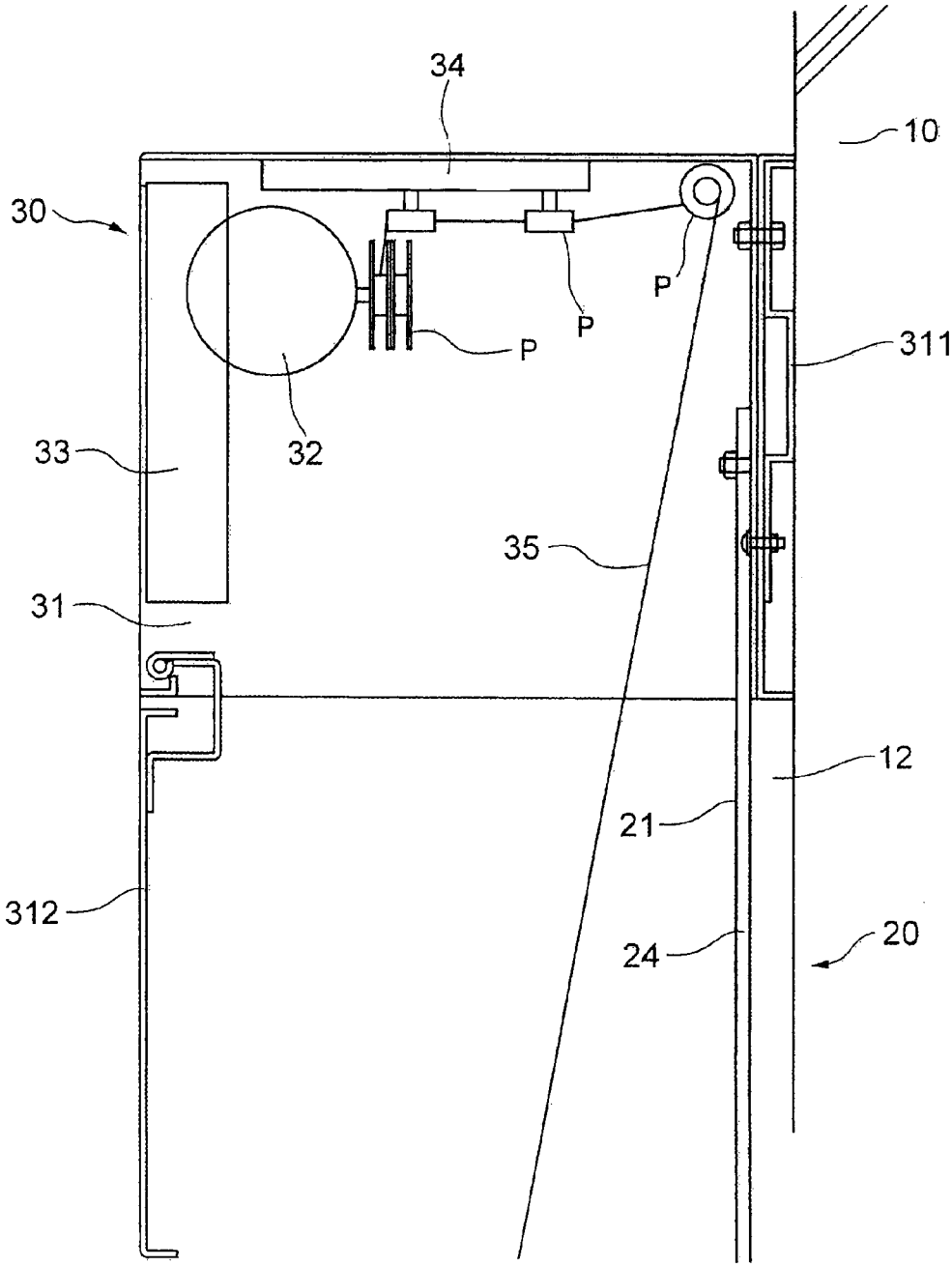
FIG. 6 is a close-up view of the upper part of the device of FIG. 2.

FIGS. 5 and 6 show the details of the Shaft End and Box areas as shown in the above mentioned FIG. 2. As FIG. 5 shows, when the Smoke-Suppressant Device 20 that is involved in this invention is in operation, Shaft End 23 is lowered to Floor FL. At this time, Wire 35 is wrapped around Winding Shaft 22A and according to the rotation of DC Gear Motor 32 (FIG. 6), which will be explained later, is lowered with the weight of such screen, etc. Also, Sheet Form Magnetic Strip 24, which is anchored to both ends of one side (back side) of Screen 21, adheres to the front of Support Rail 12 from the top in order at the same time it is rolled back up with the above mentioned Screen 21. Here, Number 211 in the Figure is screen attachment material; for example, it represents one of multiple anchoring screws for anchoring the edge of Screen 21 to the winding shaft.

FIG. 6 shows the details of the Box 31 part as shown in the above mentioned FIG. 2. The above mentioned Support Rail 12 is anchored from the bottom edge of Box Base 311, which is for Box 31 and is the surface of Building Structure Part 10, downward. Inside Box 31 that is anchored through such Box Base 311, the top edge of Screen 21 is anchored along with the top edge of Sheet Form Magnetic Strip 24 in the same manner.

The top end of Wire 35, which is wrapped around Winding Shaft 22A at the bottom end, is anchored to Pulley P of DC Gear Motor 32 through multiple Pulleys P through P inside Box 31 of Winding Device 30 and hangs down to make winding up and back possible by a signal from a smoke detector, fire alarm and such, which are not shown.

Number 33 in the Figure is the drive control board for DC Gear Motor 32 of the above mentioned Winding Device 30, and Number 34 is the down limit controlling the rotation of Pulleys P through P in the middle. Also, Panel Door 312 of Box 31 is in operation, and is therefore in an open position, but when not in operation, it can be in a closed position that stores the whole screen device mentioned above within Box 31.

Figure 7:
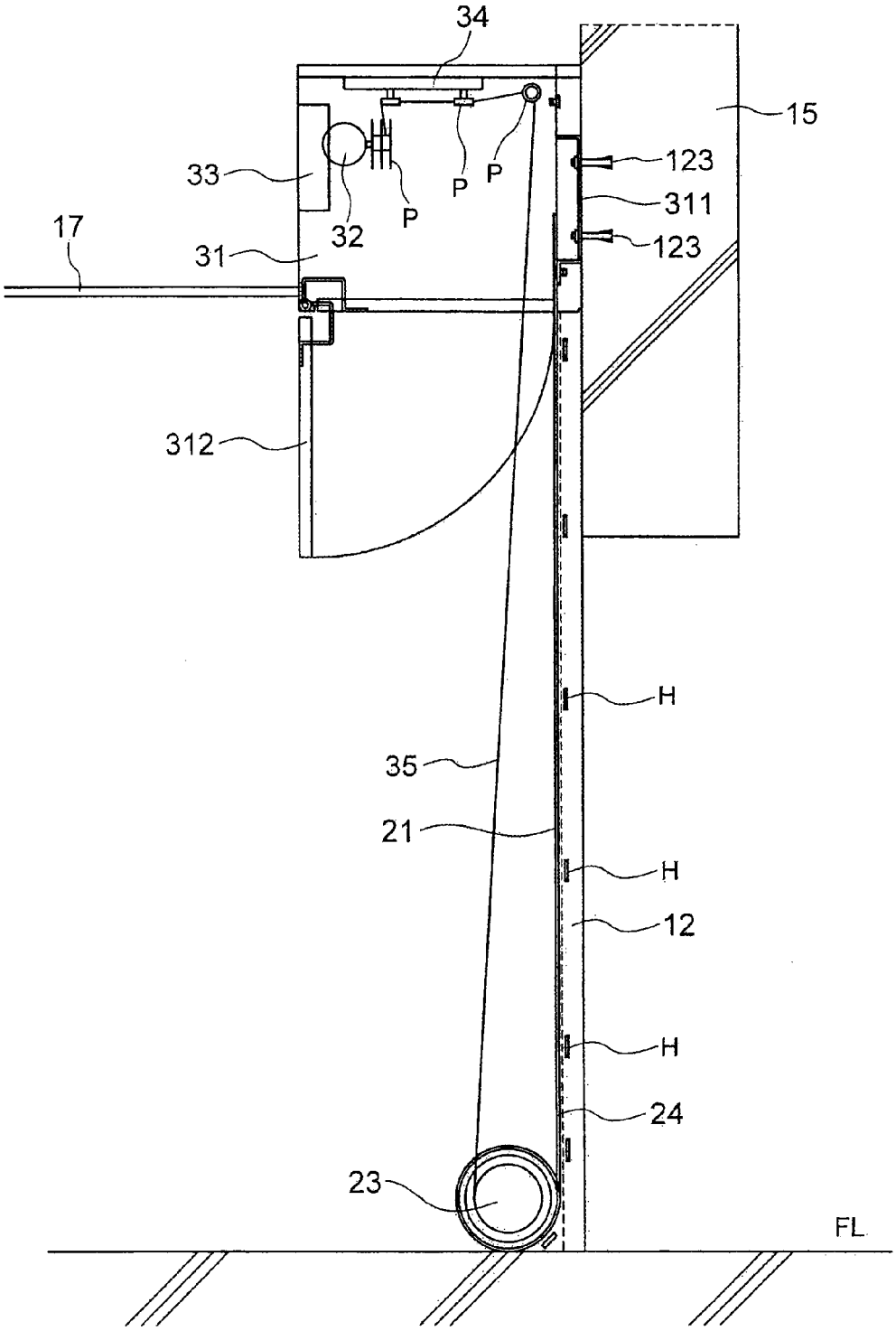
FIG. 7 is an installation illustration of application of this embodiment to an elevator opening in an RC constructed building.

FIG. 7 is a side section view of a case in which the fire-resistant smoke-suppressant device involved in the above application of this invention is applied to an RC constructed structure.

Box Base Material 311 is anchored to Upper Frame Part 15 of this building structure body through Anchor Bolts 123 and Support Rail 12 is anchored to the side wall of the opening (no number). Screen 21 is lowered by the weight of the screen and winding shaft as Wire 35 is let out for Shaft End 23 to reach Floor FL and after reaching the floor, Gear Motor 32 stops rotation by action from Down Limit 34 and goes into operation. In this case, Panel Door 312 of Box 31 will obviously open to the illustrated open position from the Ceiling Material 17 position. Symbol H through H, showing connection holes in this Figure, will be explained in the following Figure.

Figure 8:
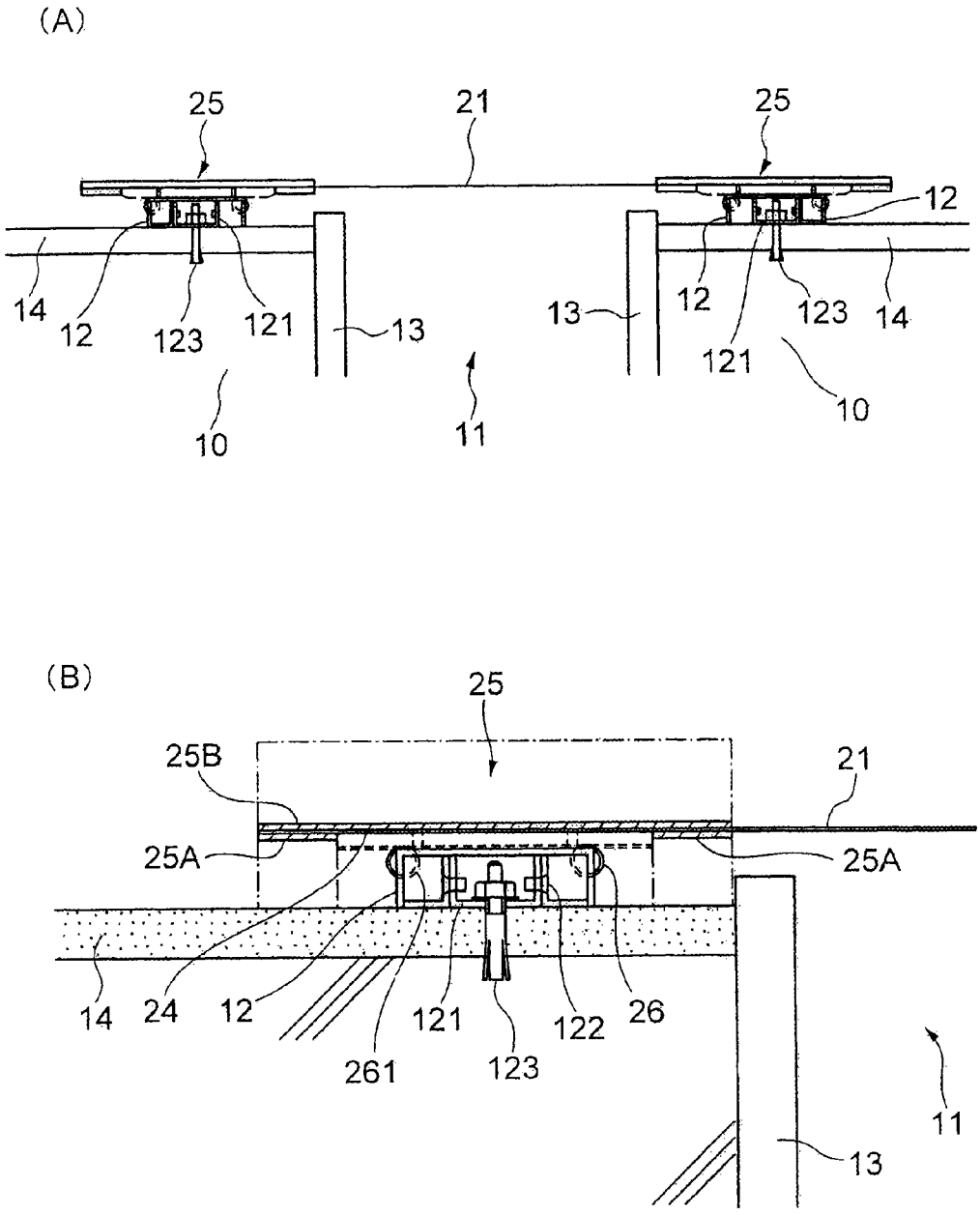
FIG. 8 is a horizontal section view of the device of FIG. 7.

FIG. 8's (A) and (B) show the installation illustration in the case of RC construction that is shown in the above mentioned FIG. 7; (A) shows a horizontal section view of FIGS. 7 and (B) shows a close-up of one edge part. In these Figures, both sides of Elevator Opening 11 are bordered by Trim Material 13 and Cement Mortar 14 is added to Building Structure Part 10. The ferrous metal Support Rail 12 is anchored to Support Rail Base 121 that is anchored to the above mentioned Cement Mortar 14 with Anchor Bolts 123 by Support Rail Attachment Material 122.

As is made especially clear in FIG. 8(B), the position shown here is one in which Screen Anchoring Method 26 has responded to the heat of flames or smoke, the Connection Hooks 261 composed of shape-memory alloy have curved, and each of the tips have fitted and attached to Connection Holes H through H on the support rail shown in FIG. 7. However, the insulation method attached to both sides of Screen 21, that is, Heat Expansion Sheets 25A and 25B are shown in a non-expanded position. Therefore, Sheet Form Magnetic Strip 24 is anchoring Sheet 21 by adhering to the surface of Support Rail 12.

Afterward, each of the above mentioned Heat Expansion Sheets 25A and 25A and Heat Expansion Sheet 25B react to the heat and begin expansion, then, as shown in the Figure with dotted lines, these heat expansion sheets ultimately expand to a thickness of 20 mm. Therefore, by expanding to the surface of Cement Mortar 14, the above mentioned Heat Expansion Sheets 25A and 25A completely seal the space between Screen 21 and the surface of Elevator Opening 11.

Also, in the same manner, the above mentioned Heat Expansion Sheet 25B expands to a thickness of approximately 20 mm as shown by the dotted lines and, as a result of these, Sheet Form Magnetic Strip 24 becomes completely surrounded by each of the above mentioned expanded Heat Expansion Sheets 25A, 25A and 25B, is sealed off heat-wise from flames or high temperature smoke, and the temperature rise of such Sheet Form Magnetic Strip 24 is prevented.

Figure 9:
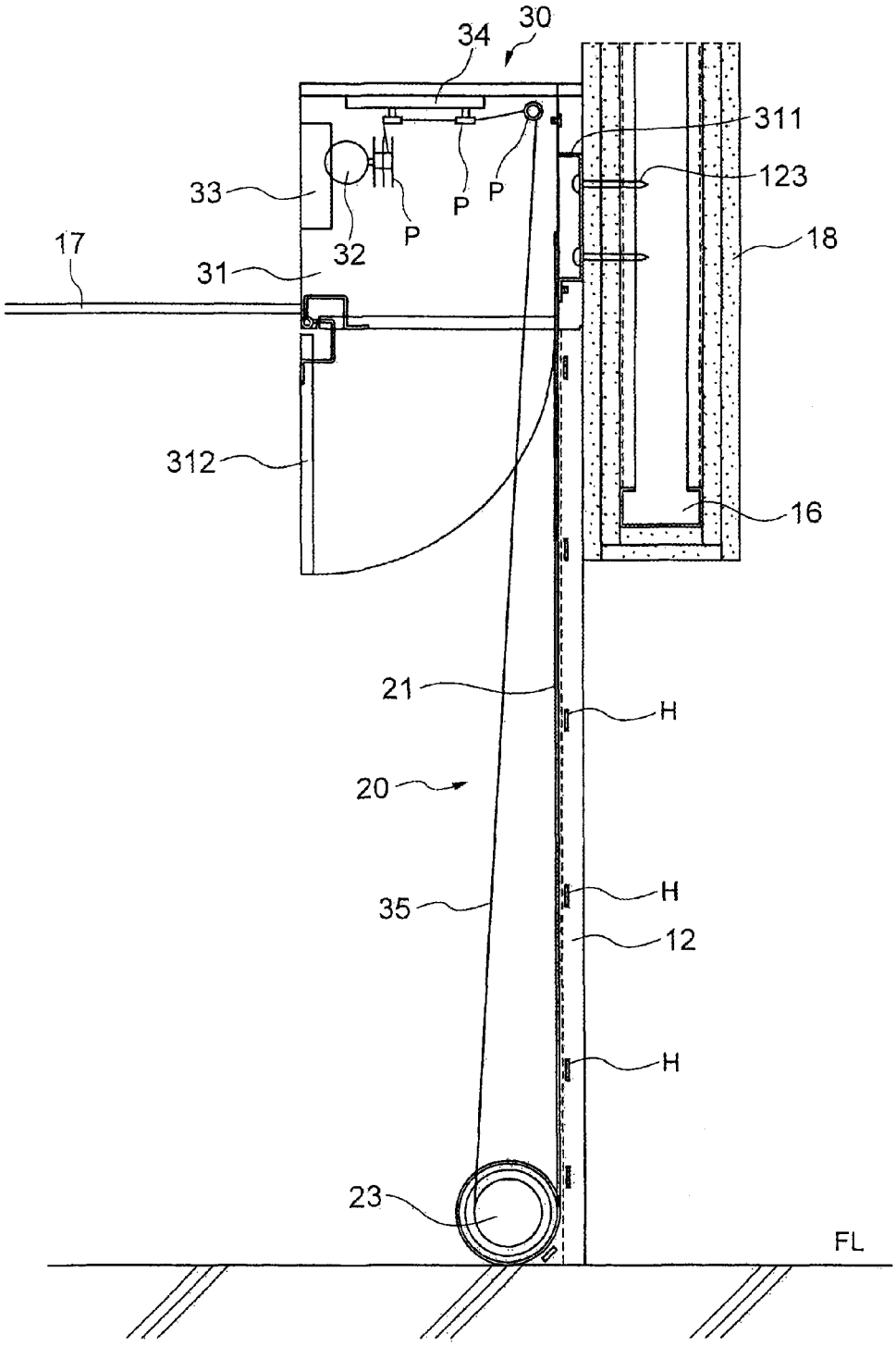
FIG. 9 is an installation illustration of application of this embodiment to an elevator opening in a steel frame constructed building.

FIG. 9 shows a vertical section view of the Fire-Resistant Smoke-Suppressant Device 20 involved in this embodiment in the case of an installation on an elevator opening in a steel frame building. For Winding Device 30 for the screen, Box Base Material 311 is anchored by Anchor Bolts 123 going through Interior Finishing Material 18, which is fixed to Crosspiece 16 of the building structure, and Storing Box 31 is anchored to such Box Base Material 311. The rest of the structure is roughly the same as for the RC construction explained in FIG. 7.

In the above mentioned applications, the structure of Connection Hooks 261 of Screen Anchoring Method 26 for anchoring Screen 21 to the opening surface is described as utilizing the multiple Holes H through H located on the side of Support Rail 12 and the tips of Connection Hooks 261 curving and fitting each Hole H, but is not limited to this. There are no illustrations regarding other applications, but it is possible to create a vertical groove along the same positions as the holes on the side of Support Rail 12 in the above mentioned applications.

In this case, for example, by creating a vertical groove lengthwise on the outer side of the above mentioned Support Rail 12, which would be enough to fit Connection Hooks 261 such as FIG. 8(B) shows, the multiple Connection Hooks 261 of Screen Anchoring Method 26 that are composed of a shape-memory alloy will fit in such vertical groove and it is possible to completely prevent such Anchoring Method 26, that is, Screen 21 and Sheet Form Magnetic Strip 24, from separating from the adhesive surface of Support Rail 12.

As a result, due to the expansion of Insulation Expansion Method 25, especially Heat Expansion Sheet 25A and 25A, it is possible to completely close off the space between Screen 21 and the surface of Cement Mortar 14, which is an opening wall, seal off even the heat of flames and high temperature smoke from the sides, and there is no decrease in adhesion strength of Sheet Form Magnetic Strip 24 due to heat.

We claim:

1. A smoke and fire obstacle, comprising:

a shaft positioned adjacent to a passageway, the shaft having a screen wound about the shaft, wherein the shaft is rotatable about an axis to deploy the screen over the passageway by unwinding the screen from the shaft as the shaft rotates;

a pair of beams near walls of the passageway, the beams having a plurality of holes generally along the length of the beams;

a plurality of heat-sensitive fasteners along sides of the screen and generally positionally corresponding to the holes in the beam, wherein when the screen is deployed over the passageway and the fasteners are heated above a predetermined temperature, the fasteners deform to a shape that engages the beams through the holes such that the screen is fastened to the beams; and a heat-sensitive expanding material along at least a portion of the screen that, if heated above the predetermined threshold temperature such that the expanding material contacts the screen and the walls of the passageway.

2. The smoke and fire obstacle of claim 1 wherein the predetermined threshold temperature is approximately 100° C.

3. The smoke and fire obstacle of claim 1 wherein the heat-sensitive fasteners comprise a nickel-titanium alloy.

4. The smoke and fire obstacle of claim 1 wherein the heat-sensitive fasteners comprise generally straight poles below the threshold temperature, and bend into a curved shape when heated above the threshold temperature.

5. The smoke and fire obstacle of claim 1 wherein the heat-sensitive expanding material comprises a butyl rubber sheet containing graphite that expands to approximately ten times its original size when heated above the threshold temperature.

6. The smoke and fire obstacle of claim 1 wherein the screen is configured to deploy over the passageway in response to a signal from a fire alarm, temperature detector, or smoke detector, or a signal from a manual switch.

7. The smoke and fire obstacle of claim 1 wherein the screen comprises at least one of a stainless fiber fabric screen or a polyimide faber fabric screen.

8. The smoke and fire obstacle of claim 1, further comprising a winding device configured to rotate the shaft to wind and unwind the screen from the shaft.

9. The smoke and fire obstacle of claim 1 wherein the fasteners comprise generally straight members below the predetermined threshold temperature, and wherein the fasteners deform to a curved shape when heated above the predetermined threshold temperature.

10. The smoke and fire obstacle of claim 1 wherein the holes comprise elongated slots.

11. The smoke and fire obstacle of claim 1, further comprising a plurality of magnetic sheets positioned along the sides of the screen such that when the screen is unwound from the shaft the magnetic sheets contact a corresponding magnetic surface to hold the screen against the walls of the passageway.

12. The smoke and fire obstacle of claim 11 wherein the heat-sensitive expanding material is larger than the magnetic strips such that when the heat-sensitive expanding material expands in response to reaching the predetermined threshold temperature, the magnetic sheets are covered by the heat-sensitive expanding material.

* * * * *